United States Patent [19]

Hanson

[11] 4,328,846

[45] May 11, 1982

[54] EXTENSION ASSEMBLY FOR A WORK BENCH

[76] Inventor: Palmer C. Hanson, Manitowish Waters, Wis. 54548

[21] Appl. No.: 194,546

[22] Filed: Oct. 6, 1980

[51] Int. Cl.[3] ..... B27H 1/02

[52] U.S. Cl. ..... 144/287; 108/97; 108/135; 269/901

[58] Field of Search ..... 144/286 R, 287; 108/97, 108/135; 269/281, 901, 904, 905; 182/155, 225

[56] References Cited

U.S. PATENT DOCUMENTS

| | | | |
|---|---|---|---|
| 103,347 | 5/1870 | Lepp . | |
| 746,972 | 12/1903 | Marsh . | |
| 1,864,840 | 6/1932 | Lehner . | |
| 2,410,330 | 10/1946 | Ashenfelter | 304/6 |
| 2,880,772 | 4/1959 | Polchow | 144/288 |
| 2,955,632 | 10/1960 | Stone | 144/288 |
| 3,342,226 | 9/1967 | Marconx et al. | 144/286 |
| 3,615,087 | 10/1971 | Hickman | 144/287 |
| 4,068,551 | 1/1978 | Kreitz | 269/901 |
| 4,155,609 | 5/1979 | Skaffe et al. | 269/901 |
| 4,161,974 | 7/1979 | Patterson | 144/286 R |
| 4,236,599 | 12/1980 | Luff et al. | 269/901 |

*Primary Examiner*—W. D. Bray

[57] ABSTRACT

An extension assembly adapted to be attached to a conventional work bench to permit elongated and bulky work pieces to be supported thereon. The extension assembly includes a horizontal member having a portion to be supported on the work bench and a vertical upright member, pivotally connected to the horizontal member, to support another portion. One or a plurality of extension assemblies may be selectably attachable to the work bench for effective use.

5 Claims, 7 Drawing Figures

EXTENSION ASSEMBLY FOR A WORK BENCH

BACKGROUND OF THE INVENTION

This invention relates in general to work supports, and, in particular, to an extension assembly adapted to be coupled to a conventional work bench.

More specifically, but without restriction to the particular use which is shown and described, this invention relates to one or more extension assemblies capable of being operatively attached to a conventional work bench for the purpose of providing an expanded work surface to accommodate large objects, such as lumber, gutters, doors and the like, on which a work task is to be performed. The invention of the application is portable in nature and may readily be attached in affixed relationship to a work bench when needed.

Many types of work benches and work supports are employed in the prior art to support, clamp or otherwise accommodate objects on which various tasks are to be performed. Although such work benches are very helpful to the workman or handyman, these devices are only capable of accommodating objects, which do not exceed an unusually large or bulky size. Otherwise, known work benches cannot suitably handle particularly large objects in the form of a gutter, an elongated piece of lumber, a door and numerous other types of articles. In the past, large objects were commonly supported by more than one work table or bench, or on a single bench in conjunction with one or more separate supports. Such techniques in the prior art have proved to be unsatisfactory and often unreliable, because the use of separate components needed to support large objects are structurally unconnected and subject to not providing adequate support for many tasks. Known work supports have thus not provided an inexpensive, but effective extension for a work bench that can be easily adapted for use to effectively handle large objects with adequate support.

SUMMARY OF THE INVENTION

It is, therefore, an object of this invention to provide an extension for a work surface.

Another object of this invention is to provide one or more extension assemblies adaptable for use with existing work benches and tables.

A further object of this invention is to expand the work support capability of existing work benches.

Still another object of this invention is to provide an extension assembly, for use with a work bench, having the capability of being effectively transported from place to place.

These and other objects are attained in accordance with the present invention wherein there is provided improved extension assemblies for a work bench, work table and the like. One or more of the extension assemblies of the invention can releasably be attached to existing work benches in any selected angular orientation, such that a significantly expanded work support structure is provided to handle and/or clamp large work pieces in the form of gutters, sheets of plywood, insulative material, wood doors, windows and numerous other household and like objects. The height of the extension assemblies herein may be adjusted according to needs for performing various tasks in conjunction with the work bench. The frame of the extensions includes pivotally mounted legs to permit it to be folded for transport from place to place, such as in an automobile and the like. One or more of the extension assemblies of the application are particularly useful in conjunction with popular commercially available work benches, such as, for example, the product being marketed under the trademark "WORKMATE" and manufactured by the Black & Decker Corporation. The extension herein disclosed significaly expands the work support capability of such work benches when attached thereto. It is also portable in nature and may be readily stored against a wall or in a corner, or it can be hung on a peg or hook.

DESCRIPTION OF THE DRAWINGS

Further objects of the invention, together with additional features contributing thereto and advantages accruing therefrom, will be apparent from the following description of preferred embodiments of the invention, which are shown in the accompanying drawings with like reference numerals indicating corresponding parts throughout, wherein.

DESCRIPTION OF THE PREFERRED EMBODIMENTS

Figure 1:
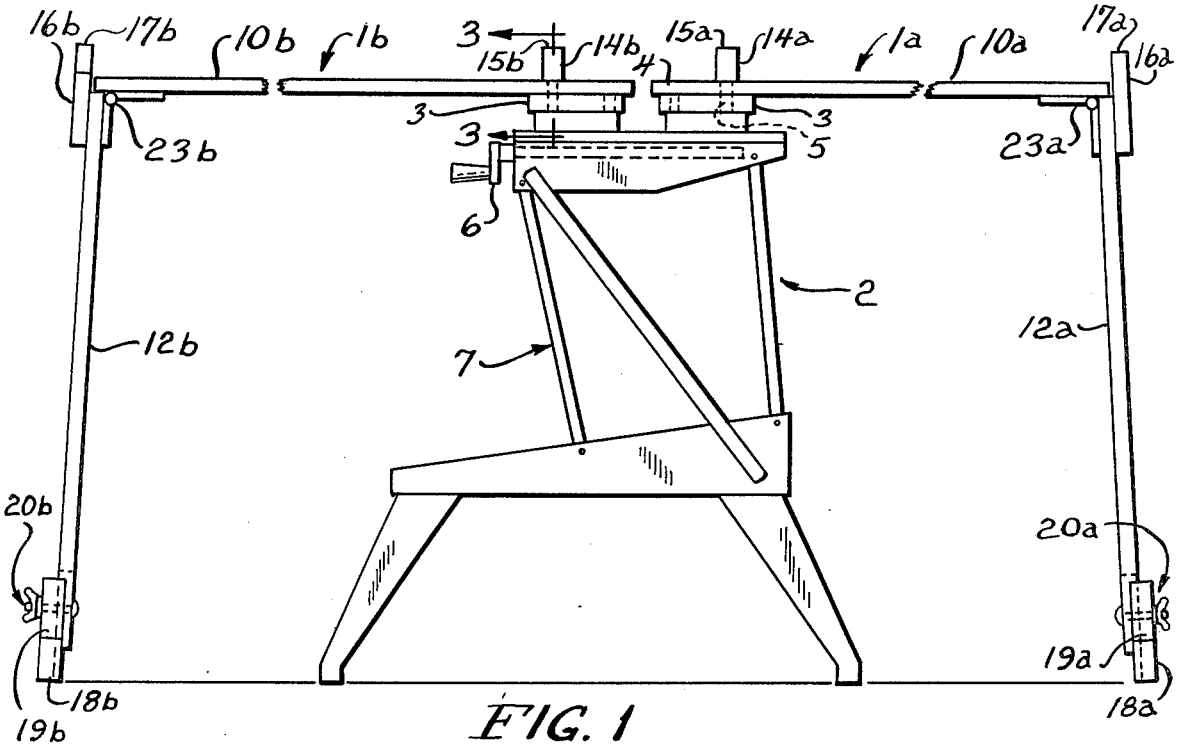
FIG. 1 is a side schematic view of one embodiment of a pair of extension assemblies of the invention connected to the upper surface of a conventional work bench.

Referring now to FIGS. 1, 3, 5 and 7, there is illustrated a first embodiment of a pair of extension assemblies of the invention is supported relationship on a conventional work bench. Although the work bench in FIGS. 1, 3, 5 and 7 may comprise a variety of different types of work benches or tables having one or more horizontally disposed work tables, the invention herein disclosed may be used with a commercially available bench, manufactured and sold under the trademark "WORKMATE" by Black & Decker Corporation. The invention of the application is illustrated in FIG. 1 as comprising two separate extension assemblies 1*a* and 1*b* which are capable of being attached to the work bench 2, either separately or simultaneously, for support of elongated objects as will be apparent in the following description.

Figure 5:
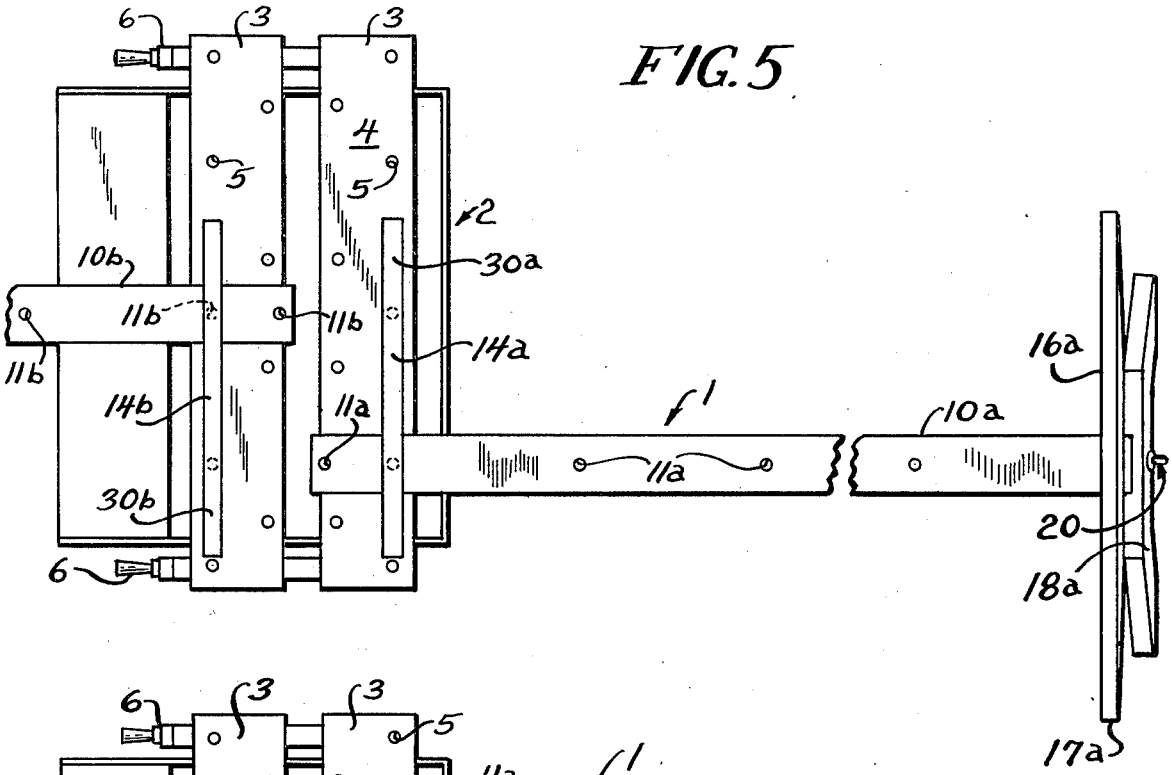
FIG. 5 is a partial top schematic view of the pair of extension assemblies of FIG. 1.

Work bench 2 includes a pair of upper table members or vises 3, which are capable of movement relative to each other in a substantial horizontal plane and form a pair of work support surfaces 4. A plurality of holes 5 are commonly provided through vises 3 of the work bench 2 as best shown in FIG. 5. The members or vises 3 may be subjected to relative movement to vary the spacing of upper surfaces 4, or to clamp objects therebetween, by operation of a typical elongated threaded rod assembly 6 positioned on opposite sides of the work bench 2. The work tables 3 and threaded shaft assembly 6 are supported on the upper portion of a typical frame and base arrangement 7 as shown in FIG. 1.

Each of the extension assemblies 1*a* and 1*b*, shown in FIGS. 1, 2, 5, and 7, are identical, except that the parts of the extension assemblies are arranged in mirror image relationship to each other. In the following description, the components of extension assembly 1*a* will be designated by reference numerals and the letter "a", while the corresponding parts of extension assembly 1*b* will include the letter "b". The extension assemblies 1*a* and 1*b* include upper horizontal members 11*a*, 11*b*, having an elongated configuration with a plurality of holes 11*a*, 11*b* selectively positioned along the length of each of the members 10*a*, 10*b*. The horizontal members 10*a*, 10*b* are constructed from a suitable material, such as wood, metal or plastic. The ends of horizontal members 10*a*, 10*b* remote from work bench 2 are carried by means of vertical upright members 12*a*, 12*b*, that may be disposed in use along a vertical axis or along a slightly sloped axis, depending on the degree of support of the ends of the horizontal members 10*a* and 10*b* desired. A portion of the horizontal members 10*a* and 10*b* in FIG. 1 overlap in contact with at least a portion of the work tables 3 and are coupled thereto by means of cross-attachment assemblies 14*a*, 14*b* that respectively form upper work support surfaces 15*a*, 15*b*. Details relating to the construction of the attachment assemblies 14*a*, 14*b* will be described in detail later.

Figure 7:
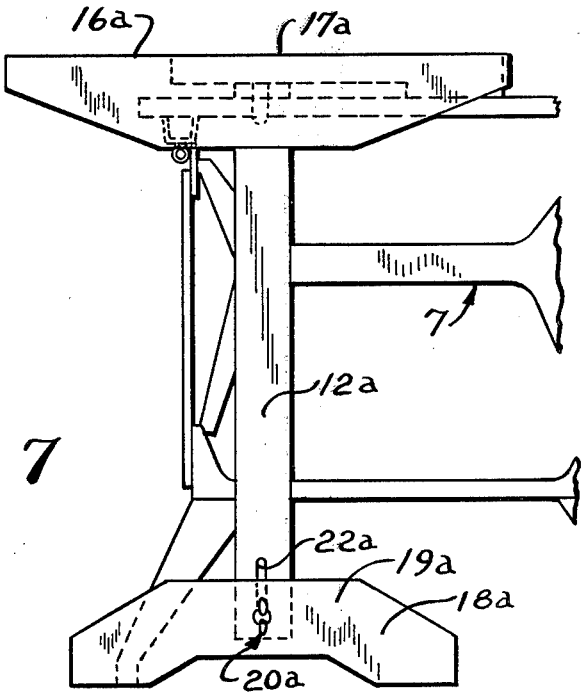
FIG. 7 is a partial end view of the pair of extension assemblies shown in FIG. 1.

The vertical members 12*a*, 12*b* further support bracket members 16*a*, 16*b*, as best shown in FIG. 7, which may possess any suitable shape, to form planar upper surfaces 17*a*, 17*b*, capable of being in substantial horizontal alignment with the upper work surfaces 15*a*, 15*b* of cross-attachment assemblies 14*a*, 14*b* of the present embodiment. The upper support members 16*a*, 16*b* may be attached to vertical upright members 12*a*, 12*b* by any suitable technique, such as by suitable threaded means, adhesive, and the like. The upright members 12*a*, 12*b*, cross-attachment assemblies 14*a*, 14*b*; and bracket members 16*a*, 16*b* may also be formed from wood, metal or plastic.

The bottom end portions of the upright members 12*a*, 12*b* include adjustment means 18*a*, 18*b* that permit the height of vertical members 12*a*, 12*b* to be adjusted for reasons to be apparent. The adjustment means 18*a*, 18*b* comprise base members 19*a*, 19*b*, being attached by a threaded shaft and wing nut arrangement 20*a*, 20*b*, to upright members 12*a*, 12*b* through vertically extending slots 22*a*, 22*b* provided therein. The wing nut of arrangement 20*a*, 20*b* may be loosened to permit movement of bases 19*a*, 19*b*, relative to upright members 12*a*, 12*b* to vary the height of the extension assemblies. The wing nuts may then be tightened to retain frictionally the bases 19*a*, 19*b* in rigid relationahip on the upright members 12*a*, 12*b* to establish a selected height of the extension assemblies. The horizontal members 10*a*, 10*b* are pivotally supported on upright members 12*a*, 12*b* by means of hinge assemblies 23*a*, 23*b* to permit the extension members to be folded for transport, such as to be carried in an automobile and the like, upon removal from the work bench.

Figure 3:
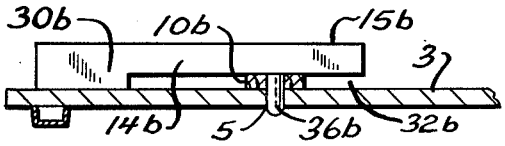
FIG. 3 is a partial cross-sectional end view taken along lines 3—3 of FIG. 1.

As shown in FIGS. 3 and 5, the cross-attachment members 14*a*, 14*b* extend along an axis perpendicular to the longitudinal axis of elongated members 10*a*, 10*b*, although members 12*a*, 12*b* may be disposed in other directions, if desired. Cross-attachment members 14*a*, 14*b* include an end portion 30*a*, 30*b* which includes a bottom surface adapted to be disposed in contacting relationship on the upper surface of a respective one of the tables or vises 3. As best shown in FIG. 3, cross-member 14*b* further includes a cut-out portion 32*b* to form a space through which horizontal member 10*b* may extend. Thus, the cross-member 14*b* is stablized in contact with vise 3 and horizontal member 10*b* to orient work surface 15*b* in a substantially horizontal plane. A cylindrical pin or peg 36*b* is disposed on the underside of the cross-attachment member 14*b* and may be inserted through a selected hole 11*b* of horizontal member 10*b* and into a selected aligned hole 5, provided in either of the vises 3 of the work bench 2. As shown in FIG. 5, the width of the extension assembly 1*b* can be selectively established, dependent on which hole 11*b* is aligned with a hole 5 for receiving pin or peg 30*b*. It should be apparent that cross-attachment assembly 14*a* is of the same construction to perform the same function as cross-member 14*b*.

In the form of the invention shown in FIG. 1, the extension assemblies 1*a*, 1*b* are attached to the top surfaces 4 of the movable work tables or vises 3 of the work bench 2. Although the extension assemblies 1*a*, 1*b* are shown extending in substantially parallel relationship in opposite directions from the work bench 2, it is within the scope of the invention to align extension assembly 1*a* relative to extension 1*b* on work bench 2 in other angular relationships, dependent on the form of the subject to be supported. In attachment of one or both of the extension assemblies 1*a*, 1*b*, holes 11*a*, 11*b* of horizontal members 10*a*, 10*b* are aligned with a pair of selected holes 5 in the vises 3, dependent on the desired spacing between outer work support surfaces 17*a*, 17*b* and the work bench 2. The pins or pegs 36*a*, 36*b*, of cross-attachment assemblies 14*a*, 14*b* are inserted through the aligned holes to secure the horizontal members 10*a*, 10*b* to the work bench. If horizontal alignment between work surfaces 15*a*, 15*b* and 17*a*, 17*b* is required, the threaded wing nut assemblies 20*a*, 20*b* are loosened to permit movement to a lower portion of slots 22*a*, 22*b* to achieve such alignment. The pair of extension assemblies 1*a*, 1*b*, as shown in FIG. 1, may be used to support or to clamp, through use of vises 3, a work piece for a variety of tasks, such as, for example to allow portable saw blade clearance. In some uses of the embodiment of FIG. 1, only one of the extension assemblies 1*a* or 1*b* may be needed, whereby the one extension assembly is attached to a selected vise 3 to form an expanded work support of the work bench.

Figure 2:
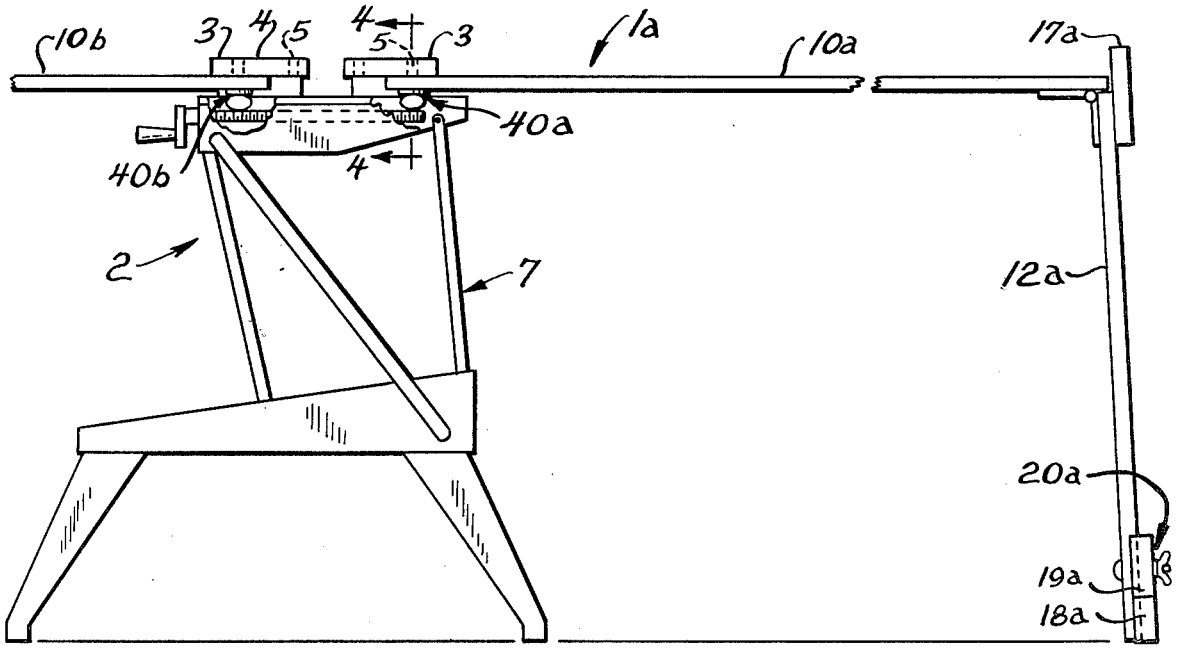
FIG. 2 is a partial side schematic view of another embodiment of a pair of extension assemblies of the invention coupled beneath the upper work surface of a conventional work bench.
Figure 4:
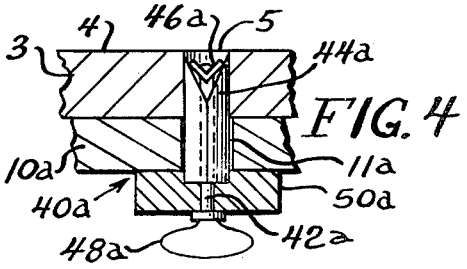
FIG. 4 is a partial sectional end view taken along lines 4—4 of FIG. 2.
Figure 6:
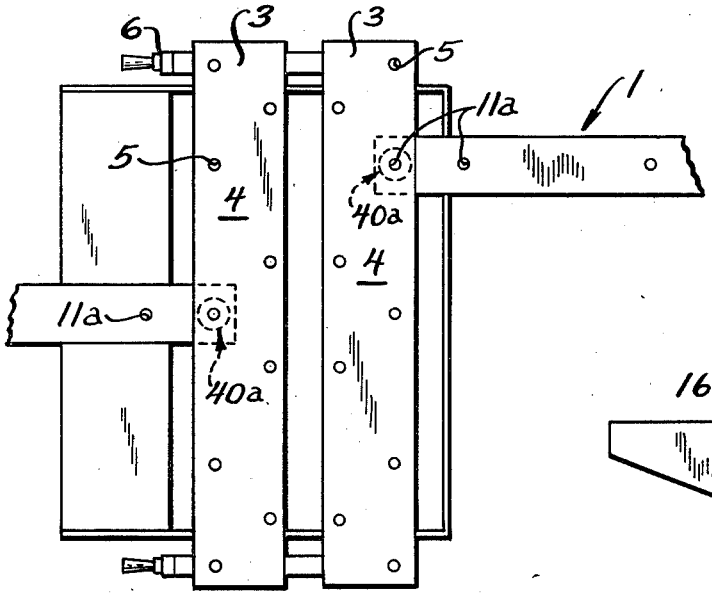
FIG. 6 is a partial top schematic view of the pair of extension assemblies shown in FIG. 2.

Referring now to FIGS. 2, 4 and 6, there is illustrated a second embodiment of the invention directed to another technique by which the work bench extensions 1*a* and 1*b* may be attached to the work bench 2. In the embodiment shown in FIGS. 2, 4 and 6, the upper surfaces 4 of the work table or vises 3 may be utilized to support a work piece in conjunction with the support surfaces 17*a*, 17*b*, attached to the upright members 12*a*, 12*b*. The horizontal members 10*a*, 10*b* are secured to the underside of the bottom surfaces of the work tables 3 of the work bench 2 through the use of expandable attachment assemblies 40*a*, 40*b*. For purposes of illustration, the details of expandable attachment assembly 40*a* are only shown in FIG. 4, but it should be apparent that attachment assembly 40*b* has a like construction. The attachment assembly 40*a* includes a threaded elongated shaft 42*a*, which cooperates with a split expandable sleeve 44*a*, such that upon tightening of threaded shaft 42*a*, the split sleeve 44*a* is expanded outward into frictional engagement with a selected hole 5 of the table or vise 3 of the work bench 2. Such expansion of the expandable sleeve 44*a* is effected by a wedge-like element or angle 46 rigidly attached to the end of the threaded shaft 42*a*. Movement of angle 42*a*, through manual rotation of a wing-like head 48*a* of threaded shaft 42*a*, causes frictional engagement of the sleeve 44*a* in a selected hole 5 in securement to the table 3. The threaded shaft 42*a* further extends through a selected hole 11*a* to support the horizontal member 10*a* between the underside of the work table 2 and a washer member 50*a* in contacting relationship therewith.

If necessary, the wing nut adjustment assembly 20*a* can be loosened and base 19*a* adjusted to insure that horizontal alignment of surfaces 17*a* with the top surface 4 of the work tables 3 is achieved. As similar to the preceding embodiment, extension assembly 1*a* can be disposed at an angle other than in a parallel relationship to the extension assembly 1*b* as shown in FIG. 6 in accordance with the size of the workpiece and the work to be performed thereon. Likewise, only one of the extension assemblies 1*a*, 1*b* may be attached to the work bench 5 where desired. In instances where an extremely large item is to be supported, it is within the scope of the invention to use more than two extension assemblies using the techniques described in conjunction with the embodiments of FIGS. 1 and 2.

While the invention has been described with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mdoe contemplated for carrying out this invention, but that the invention will include all embodiments falling within the scope of the appended claims.

What is claimed is:

1. An extension assembly for attachment to a work bench to accommodate and support and elongated object comprising at least one horizontal member having a first portion adapted to be releasably attached to a horizontal table of the work bench and having an auxiliary object support surface spaced from the horizontal table, at least one substantially upright member operatively connected to said at least one horizontal member and having a bottom portion adapted to contact a support surface, said upright member acting to vertically support another portion of said at least one horizontal member, said first portion of said at least one horizontal member lying in sandwiched relationship to the horizontal table of the work bench while being supported thereby, releasable attachment means coupled to said at least one horizontal member securing said first portion to the work table, said first portion being disposed in sandwiched relationship above the horizontal table, said releasable attachment means including a member having a lower surface in bearing contact with the upper surface of the work bench and an upper surface forming an object surface above the surface of the horizontal table of the work bench and the at least one horizontal member, said member having at least one downwardly extending pin in said sandwiched relationship for insertion into a vertical hole in the horizontal table of the work bench at least through said horizontal member for securing said first portion thereto, and said horizontal member being vertically adjustable to selectively align said auxiliary support surface with said upper surface of said member along a desired plane.

2. An extension assembly for attachment to a work bench to accommodate and support an elongated object comprising:

at least one horizontal member having a first portion adapted to be releasably attached to a horizontal table of the work bench;

at least one substantially upright member operatively connected to said at least one horizontal member and having a bottom portion adapted to contact a support surface;

said upright member acting to vertically support amother portion of said at least one horizontal member;

said first portion of said at least one horizontal member lying in sandwiched relationship beneath the horizontal table of the work bench while being supported thereby and having a surface in contact with the underside of the horizontal table;

releasable attachment means coupled to said at least one horizontal member securing said first portion to the work table;

said releasable attachment means including a member having an upper surface in contact with the underside of said at least one horizontal member;

said releasable attachment means further having at least one expandible member extending upward through said member for frictional engagement with a hole in the horizontal table of the work bench; and said horizontal member being vertically adjustable to selectively align said auxiliary support surface with the upper surface of the horizontal table along a desired plane.

3. The extension assembly according to claim 1 or 2 wherein said upright member is pivotally connected to said at least one horizontal member to permit said upright member and said at least one horizontal member to be substantially folded for portability.

4. The extension assembly according to claim 1 or 2 wherein said at least one horizontal member is a plurality of members adapted to be releasably supported on the horizontal table of the work bench, each of said plurality of horizontal members being connected to a respective upright member.

5. The extension assembly according to claim 1 wherein said member of said releasable attachment means further includes a second lower surface lying in spaced relationship to the upper surface of the work bench in said sandwiched relationship, said pin extending downward into said hold of the horizontal table from said second lower surface.

* * * * *